US011376643B2

(12) United States Patent
Guo et al.

(10) Patent No.: US 11,376,643 B2
(45) Date of Patent: Jul. 5, 2022

(54) ALUMINUM ALLOY WHEEL SHAPE-CORRECTING EQUIPMENT

(71) Applicant: CITIC Dicastal Co., Ltd., Qinhuangdao (CN)

(72) Inventors: Jiandong Guo, Qinhuangdao (CN); Le Zhang, Qinhuangdao (CN); Yuemei Zang, Qinhuangdao (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 0 days.

(21) Appl. No.: 17/092,780

(22) Filed: Nov. 9, 2020

(65) Prior Publication Data

US 2021/0154719 A1 May 27, 2021

(30) Foreign Application Priority Data

Nov. 25, 2019 (CN) ..... 201911161769.0

(51) Int. Cl.

| | |
|---|---|
| ***B21D 3/16*** | (2006.01) |
| ***B21D 3/02*** | (2006.01) |
| ***B21D 43/00*** | (2006.01) |

(52) U.S. Cl.

CPC ..... *B21D 3/16* (2013.01); *B21D 3/02* (2013.01); *B21D 43/003* (2013.01)

(58) Field of Classification Search

CPC ... B21D 3/00; B21D 3/02; B21D 3/10; B21D 3/14; B21D 3/16; B21D 1/02; B21D 43/003; B21D 53/264; B21D 53/30; B21D 53/26

See application file for complete search history.

(56) References Cited

U.S. PATENT DOCUMENTS

| | | | | |
|---|---|---|---|---|
| 6,513,241 | B1 * | 2/2003 | Shalosky | B23P 19/04 29/525 |
| 7,513,034 | B2 * | 4/2009 | Nakano | B21D 53/26 29/802 |
| 10,272,483 | B1 * | 4/2019 | Liu | B21D 53/262 |

* cited by examiner

*Primary Examiner* — Teresa M Ekiert
(74) *Attorney, Agent, or Firm* — IPro, PLLC

(57) ABSTRACT

The invention discloses aluminum alloy wheel shape-correcting equipment which comprises rack, an output end of positioning air cylinder is arranged at the bottom of the rack corresponding to the center of the upper rotating disc and is vertically and upwards connected with positioning cone.

6 Claims, 5 Drawing Sheets

ALUMINUM ALLOY WHEEL SHAPE-CORRECTING EQUIPMENT

TECHNICAL FIELD

The disclosure herein relates to the field of aluminum alloy wheel manufacturing, in particular to aluminum alloy wheel shape-correcting equipment.

BACKGROUND

Aluminum alloy wheel is manufactured by the processes of aluminum ingot melting, blank low pressure casting, blank heat treatment, machining, surface coating, product packaging, etc., wherein the purpose of the heat treatment process is to improve the mechanical properties of aluminum alloy wheel, enhance the corrosion resistance of aluminum alloy wheel, improve the machining properties, and obtain dimensional stability of the product, however, during the heat treatment process, internal and external stresses are released due to the change of internal microstructure, thus forming a blank of aluminum alloy wheel, specifically, during the heat treatment and subsequent machining process, the casting will have shape and dimensional changes, which will bring unnecessary effects to all processes.

In order to provide the best possible aluminum alloy blank for the subsequent machining process, the aluminum alloy blank is corrected to restore the deformation to the minimum possible state.

SUMMARY

In view of this, the present invention provides an aluminum alloy wheel shape-correcting equipment, which can correct the wheel shape of aluminum alloy wheel.

In order to achieve the purpose, the technical scheme of the invention is realized as follows:

An aluminum alloy wheel shape-correcting equipment comprises a clamp device arranged on upper rotating disc connected with an output end rack provided with gear motor at the upper part;

The output end of positioning air cylinder arranged at the bottom of rack corresponding to the upper rotating disc center position is vertically upwards connected with the output end of positioning cone and also jacking air cylinder arranged at the bottom of the output end is vertically upwards fixedly connected with lifting base and is provided with at least two conical roller devices.

In some embodiments, the guiding column is fixed to lifting base and a tapered roller assembly including conical roller and bearing assembly is mounted to the top of guiding column by bearing assembly.

In some embodiments, a guiding plate lower penetration guiding plate is also provided on rack.

In some embodiments, the guiding column includes three uniformly arranged lifting base in one or more embodiments, each guiding column having a tapered roller assembly mounted on its top.

In some embodiments, the gripping device includes at least two evenly distributed upper rotating disc.

In some embodiments, the gripping device includes compressing oil cylinder mounted on upper rotating disc and hydraulic rotating joint mounted on rack and oil pipe output ends connected hydraulic rotating joint and compressing oil cylinder with jaws mounted thereon.

Compared with the prior art, the X-ray machine ray tube heat dissipation device provided by the invention has the following advantages:

The invention can meet the requirement of shape correction of aluminum alloy wheel, and has the characteristics of simple structure and convenient operation.

BRIEF DESCRIPTION OF FIGURES

The accompanying drawings, which are included to provide a further understanding of the invention, illustrate embodiments of the invention and together with the description serve to explain the invention and do not constitute a limitation of the invention. In the drawings.

DESCRIPTION OF REFERENCE NUMERALS

Figure 1:
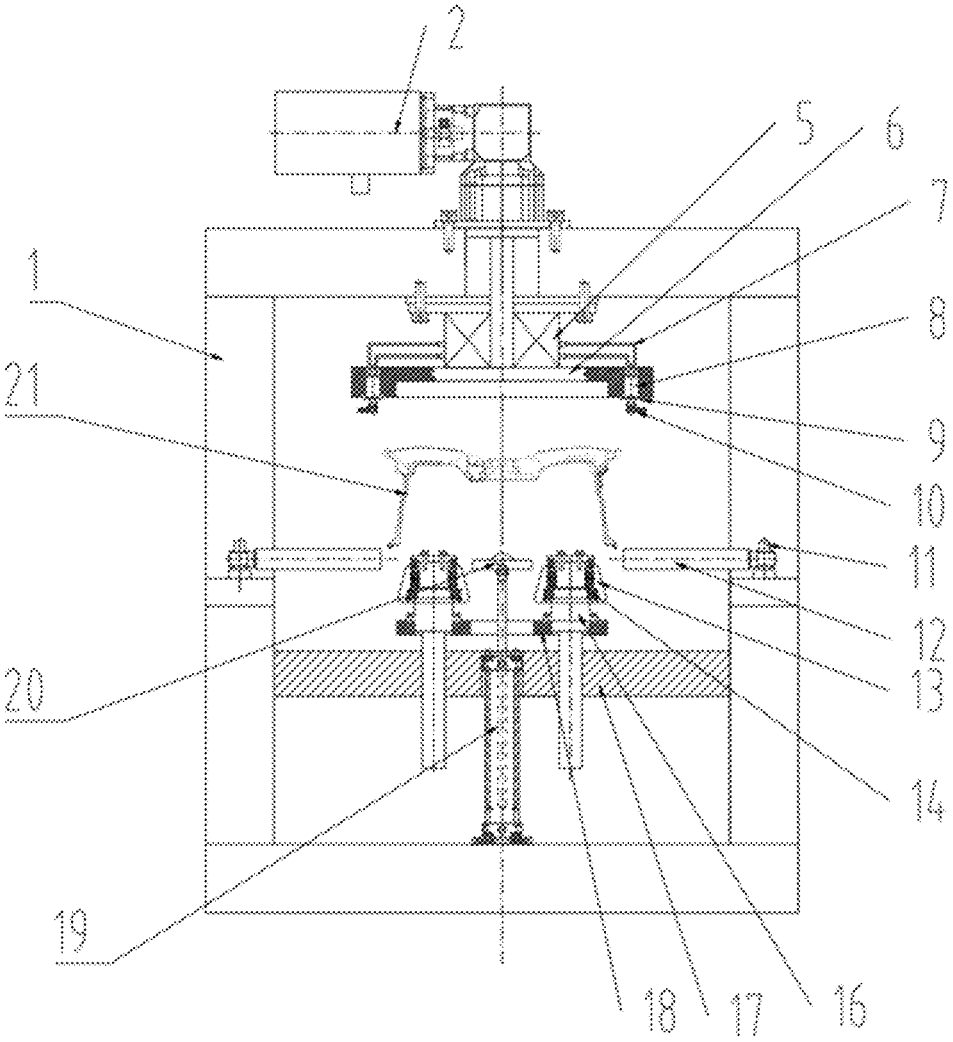
FIG. 1 is a front view of aluminum alloy wheel shape-correcting equipment of one form of the present invention.

1—rack, 2—gear motor, 5—hydraulic rotating joint, 6—upper rotating disc, 7—oil pipe, 8—compressing oil cylinder, 9—screw, 10—compressing claw, 11—bearing block, 12—carrier roller, 13—conical roller, 14—bearing assembly, 16—guiding column, 17—guiding plate, 18—lifting base, 19—positioning air cylinder, 20—positioning cone, 21—wheel, 22—jacking air cylinder.

DETAILED DESCRIPTION

It should be noted that embodiments of the present disclosure and features of the embodiments may be combined with one another without conflict.

The technical solution of the present disclosure will be described clearly and completely hereinafter with reference to the accompanying drawings and in combination with embodiments, and obviously, the embodiments described are only a part of embodiments of the present disclosure, and are not all of embodiments thereof. Based on the embodiments of the present disclosure, all other embodiments obtained by a person of ordinary skill in the art without involving any inventive effort fall within the protection scope of the present disclosure.

The aluminum alloy wheel shape-correcting equipment of an embodiment of the present invention is described below in conjunction with an embodiment with reference to FIG. 1-5.

An aluminum alloy reel-correcting equipment comprises a rack 1, a gear motor 2, an upper rotating disc 6, a lower rotating disc 5, a compressing oil cylinder 8, a compressing claw 10, a bearing roller 13, a bearing assembly 14, a guiding column 16, a lifting base 18, a guiding plate 17, a sealing air cylinder 22, a positioning air cylinder 19, a positioning joint 20, a bearing block 11, a carrier roller 12 and the like. The gear motor 2 is arranged at the top end of the rack 1 through a bolt, the upper rotating disk 6 is connected with the gear motor 2, the gear motor 2 can drive the upper rotating disk 6 to rotate, the hydraulic rotating joint 5 is fixed on the rack 1 through a bolt and is connected with the upper rotating disk 6, the compressing cylinder 8 is arranged on the upper rotating disk 6 through a screw 9, the compressing cylinder 8 and the hydraulic rotating joint 5 are connected through a compressing pipe 7, the compressing cylinder 10 is arranged on the compressing cylinder 8, the control roller 13, the bearing assembly 14 and the sizing cylinder 16 are assembled together, three sets of bolts are arranged on the sliding cylinder 18, the guiding cylinder 16 penetrates through the sizing cylinder 16 and acts as a guide, the three sets of bolts are arranged at the bottom end of the sliding cylinder 1 and act as a guide, and the three sets of bolts are arranged on the sliding cylinder 18, and can drive lifting base 18 to move from top to bottom, positioning air cylinder 19 is installed at the bottom end of rack 1, positioning cone 20 is installed on a piston rod of positioning air cylinder 19, bearing block 11 is fixed on rack 1, carrier roller 12 is connected with bearing block 11, and a plurality of carrier rollers 12 and bearing block 11 form a roller way conveying system.

Figure 2:
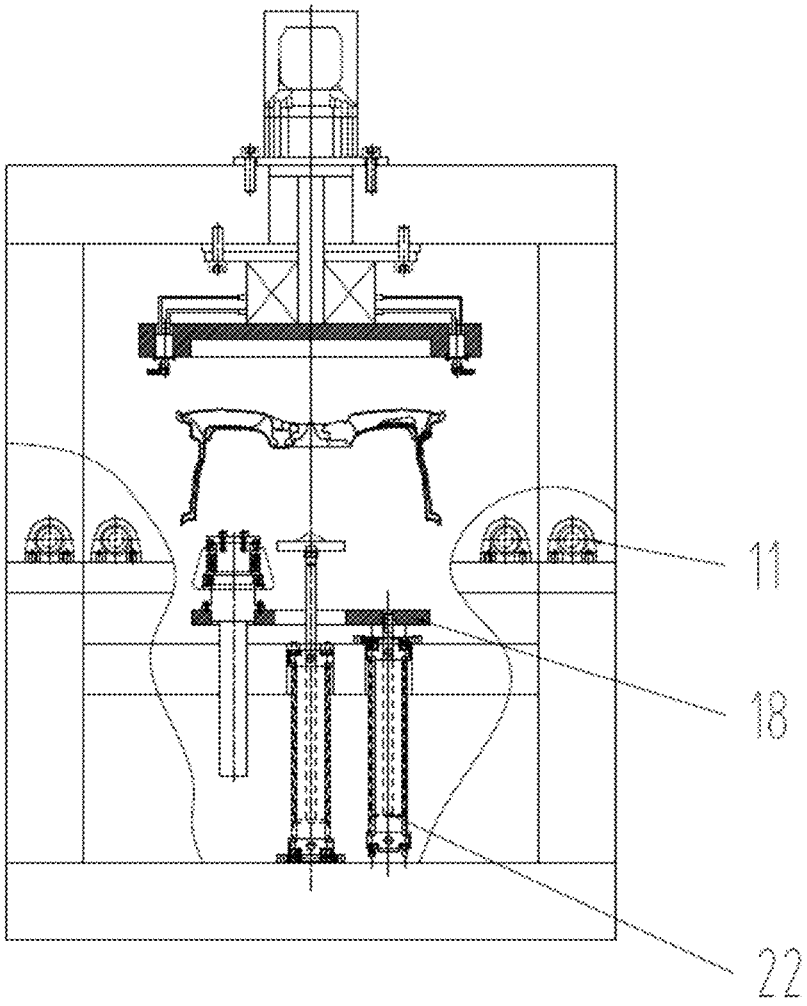
FIG. 2 is a left side view of aluminum alloy wheel shape-correcting equipment according to one aspect of the present invention.
Figure 3:
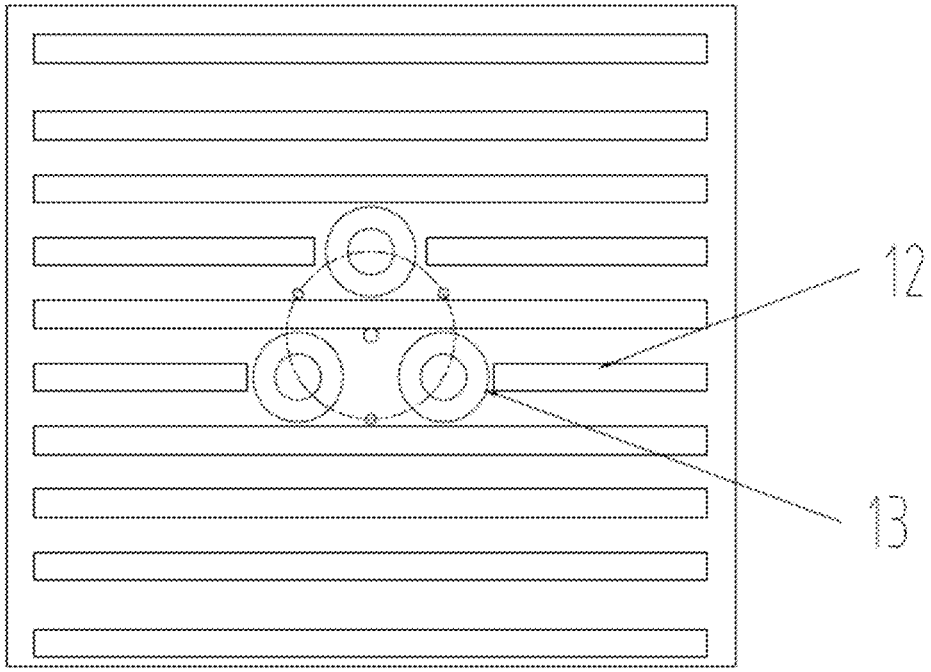
FIG. 3 is a top view of portion conical roller of aluminum alloy wheel shape-correcting equipment according to the present invention.

In operation, the roller conveyor system of carrier roller 12 and bearing block 11 transports the aluminum alloy wheel 21 to the central working area of the plant (FIG. 2).

Figure 4:
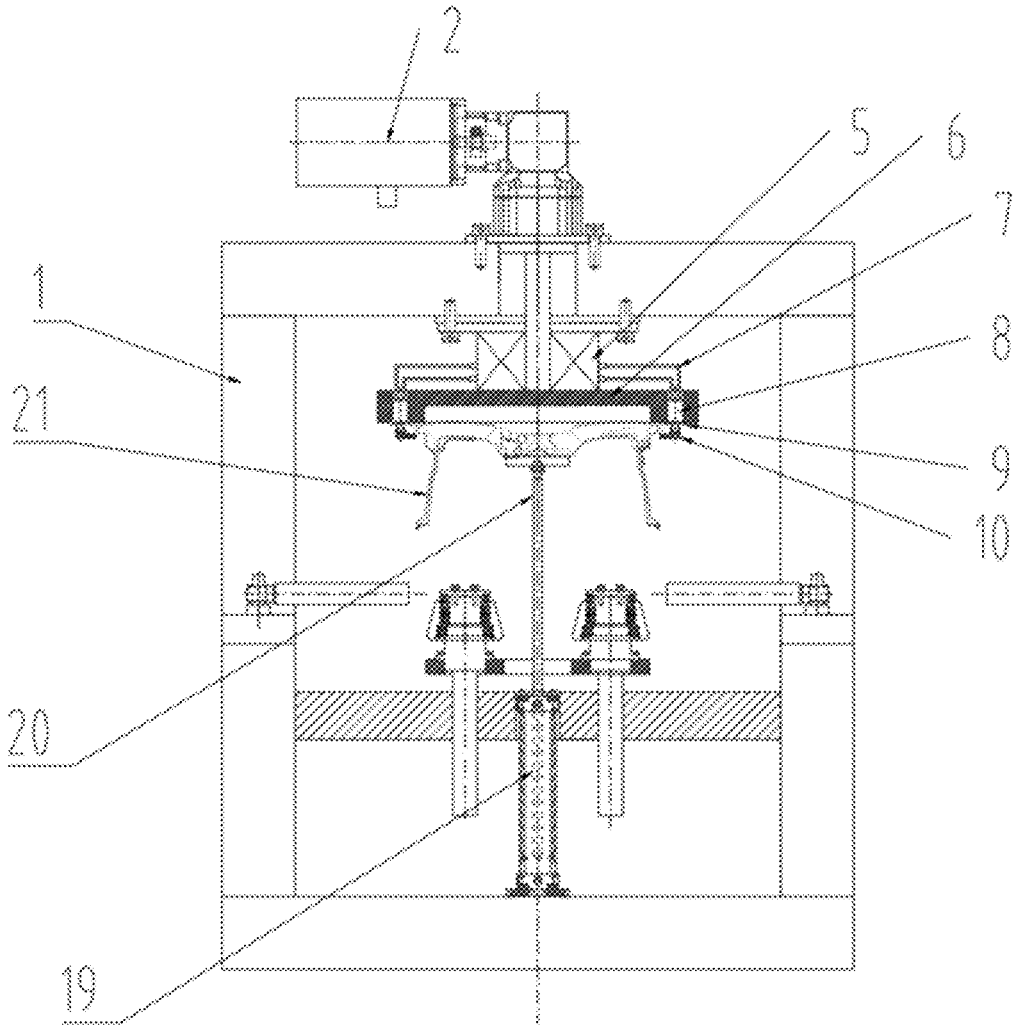
FIG. 4 is a schematic representation of the operation positioning air cylinder of aluminum alloy wheel shape-correcting equipment according to the present invention.

The positioning air cylinder 19 then drives the positioning cone 20 to move upward, lifting the aluminum alloy wheel 21 up to the upper rotating disc 6, and the compressing oil cylinder 8 drives the compressing claw 10 to rotate and the compress wheel 21 with the compressing claw 10 (FIG. 4).

Figure 5:
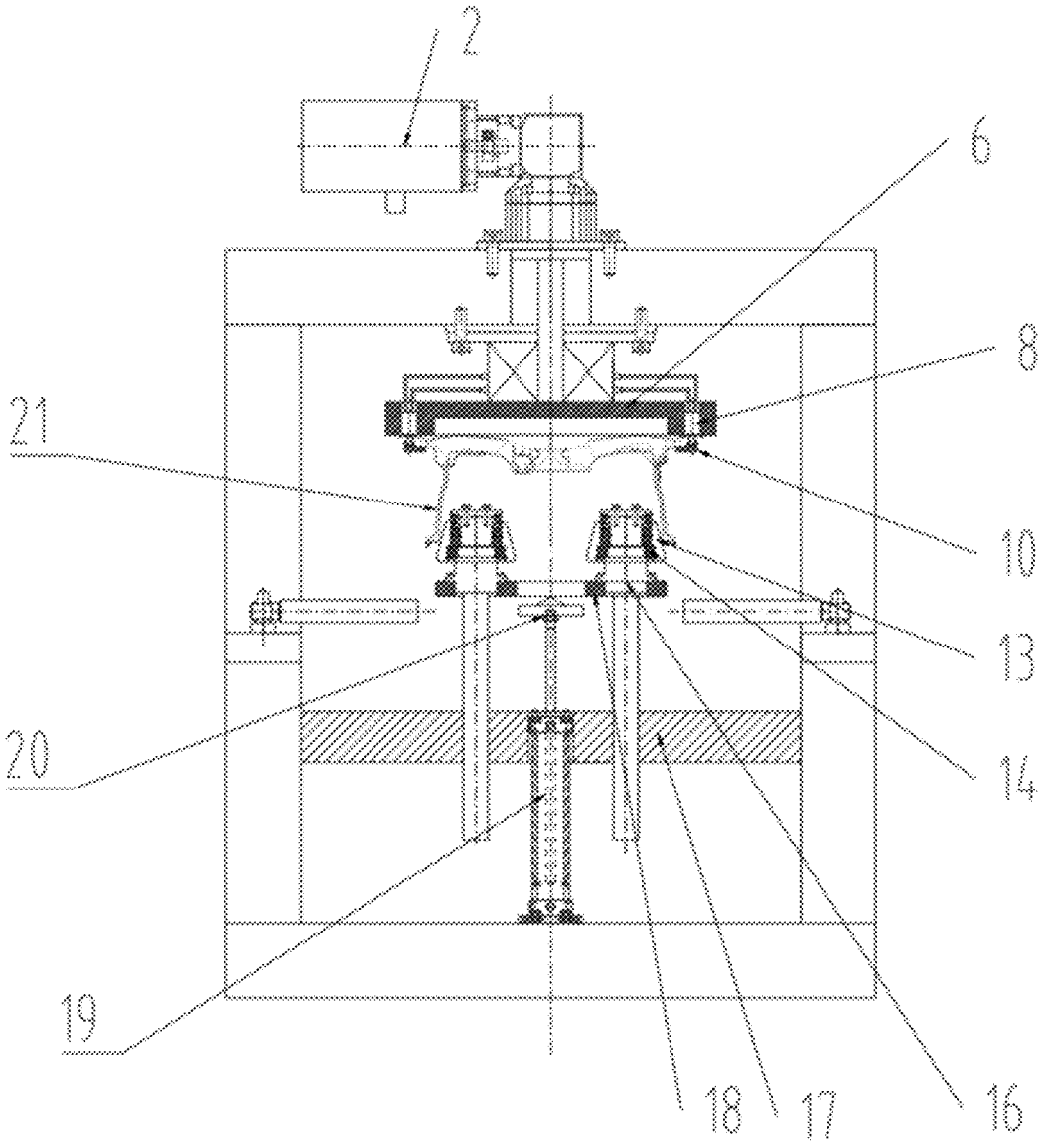
FIG. 5 is a schematic representation of the operation conical roller of aluminum alloy wheel shape-correcting equipment according to the present invention.

After the compressing claw 10 presses the wheel 21, the positioning air cylinder 19 brings the positioning cone 20 down to the initial position (FIG. 5).

Then, the gear motor 2 rotates the upper rotating disc 6 slowly. Since the hydraulic rotating joint 5 is mounted, the compressing claw 10 is still in a state of pressing the reel 21 at this time. Meanwhile, the three packing air cylinders 22 synchronously drive the lifting base 18 to move upwards and drive the three sets of the control roller 13, the bearing assembly 14 and the sizing column 16 to move upwards until the control roller 14 contacts with the inner wall of the wheel 21 (FIG. 5).

During the racking air cylinder 22 up run, the aluminum alloy wheel 21 is slowly rotating; meanwhile, since the bearing assembly 14 is provided in the semiconductor roller 13, the semiconductor roller 13 also rotates. Therefore, the packing air cylinder 22 causes the three control rollers 13 to roll and press the cavity of the aluminum alloy wheel 21 outwards and deform the cavity, thereby performing the shape correction function.

Compared with the prior art, the aluminum alloy wheel shape-correcting equipment of the present invention has the following advantages:

The invention can meet the requirement of shape correction of aluminum alloy wheel, and has the characteristics of simple structure and convenient operation.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An aluminum alloy wheel shape-correcting equipment, comprising:

a rack;

a gear motor arranged on an upper part of the rack;

an upper rotating disc connected with an output end of the gear motor;

clamping devices arranged on the upper rotating disc;

a positioning air cylinder arranged at a bottom of the rack corresponding to a center of the upper rotating disc;

a positioning cone connected with an output end of the positioning air cylinder, wherein the positioning air cylinder drives the positioning cone to move upward and downward;

jacking air cylinders arranged at the bottom of the rack;

a lifting base fixedly connected with output ends of the jacking air cylinders, the jacking air cylinders drive the lifting base to move upward and downward; and at least two conical rolling wheel devices arranged on the lifting base.

2. The aluminum alloy wheel shape-correcting equipment according to claim 1, further comprising:

guiding columns fixed to the lifting base, wherein each conical rolling wheel device includes a conical roller and a bearing assembly, and each conical roller is mounted at a top end of the corresponding guiding column through the corresponding bearing assembly.

3. The aluminum alloy wheel shape-correcting equipment according to claim 2, further comprising:

a guiding plate arranged on the rack, lower parts of the guiding columns penetrate through the guiding plate.

4. The aluminum alloy wheel shape-correcting equipment according to claim 3, wherein the guiding columns includes three guiding columns evenly arranged on the lifting base, and the corresponding conical rolling wheel device is mounted at a top end of each guiding column.

5. The aluminum alloy wheel shape-correcting equipment according to claim 1, wherein the clamping devices includes at least two clamping devices evenly distributed on the upper rotating disc.

6. The aluminum alloy wheel shape-correcting equipment according to claim 5, wherein each clamping device includes:

a compressing oil cylinder mounted on the upper rotating disc;

a hydraulic rotating joint mounted on the rack;

an oil pipe connecting the corresponding hydraulic rotating joint with the corresponding compressing oil cylinder; and a compressing claw mounted at an output end of each compressing oil cylinder.

* * * * *